US005824367A

United States Patent [19]

Park et al.

[11] Patent Number: 5,824,367

[45] Date of Patent: Oct. 20, 1998

[54] METHOD FOR THE DEPOSITION OF DIAMOND FILM ON AN ELECTROLESS-PLATED NICKEL LAYER

[75] Inventors: Jung-Il Park, Anyang; Kwang-Ja Park, Seoul, both of Rep. of Korea

[73] Assignee: National Institute of Technology and Quality, Kwacheon, Rep. of Korea

[21] Appl. No.: 793,256

[22] PCT Filed: Aug. 24, 1994

[86] PCT No.: PCT/KR94/00115

§ 371 Date: Feb. 21, 1997

§ 102(e) Date: Feb. 21, 1997

[87] PCT Pub. No.: WO96/06206

PCT Pub. Date: Feb. 29, 1996

[51] Int. Cl.[6] ..... C23C 28/00; C23C 16/26; B05D 3/10

[52] U.S. Cl. ..... 427/249; 427/305; 427/438; 427/577; 427/405; 427/575; 427/571

[58] Field of Search ..... 427/577, 249, 427/575, 571, 305, 404, 405, 438; 423/446

[56] References Cited

U.S. PATENT DOCUMENTS 4,906,532 3/1990 Spencer, Jr. .

5,487,945 1/1996 Yang et al. ..... 428/408

FOREIGN PATENT DOCUMENTS 0139258 5/1985 European Pat. Off. .
63-312694 12/1988 Japan .
2038214 7/1980 United Kingdom .

OTHER PUBLICATIONS

*The Journal of the Surface finishing Society of Japan,* Diamond Synthesis on Fe–P, Ni–P, Plated Substrate, 1996, pp. 44–48 with English language abstract.

*Primary Examiner*—Roy V. King
*Attorney, Agent, or Firm*—Staas & Halsey

[57] ABSTRACT

A method for the deposition of a diamond film, which includes the steps of immersing metallic or nonmetallic substrate in and electroless nickel plating bath containing a reducing agent to form a nickel layer; and depositing the diamond film on the electroless nickel plated substrate. As a result, employing electroless plating to form an inter layer is improved. In addition, the diamond film can be formed regardless of the type of materials used.

3 Claims, 1 Drawing Sheet

METHOD FOR THE DEPOSITION OF DIAMOND FILM ON AN ELECTROLESS-PLATED NICKEL LAYER

BACKGROUND OF THE INVENTION

1. Field of the Invention

The present invention relates, in general, to a method for depositing diamond film and, more specifically, to a method for the deposition of diamond film on an electroless-plated nickel layer.

2. Description of the Prior Art

Diamond film is generally used for various purposes, such as protective coatings, engineering materials, electronic materials and the like, since it has the same superior physical properties as natural diamond.

Methods for producing a diamond coating are largely divided into chemical vapor deposition(hereinafter referred to as "CVD") and physical vapor deposition(hereinafter referred to as "PVD"). The CVD methods include microwave CVD, thermal filament CVD, high frequency CVD, electron cyclotron resonance microwave CVD, direct current plasma CVD, and so on, whereas the PVD methods include ion plating, ion beam sputtering, ion deposition, ion beam deposition and so on.

These diamond coating methods are different from conventional methods which employ high temperature and high pressure. In addition, objects with various shapes can be coated and the coated area can be enlarged thereby. Accordingly, diamond coating methods arouse worldwide interest in an economical aspect and application, and are being actively industrialized, especially among the advanced countries.

However, all materials can not be coated with diamond. Because diamond is non-metallic and non-mineral, the diamond film is not easily formed on such a substance as metal or ceramics. In addition, even if formed, the adhesion to a base layer is questionable.

A method is well known for forming a diamond coating on metal such as silicon or oxide materials such as alumina and silica. However, due to the poor adhesion as stated above, it is difficult to form a diamond coating on high speed tool steel, hard metal (M or P type), fine particle hard metal, or stainless steel, in practice.

Much effort have been made to solve the adhesion problem. For example, Japanese Patent Laid-Open Publication No. Heisei 3-232973 discloses that $Al_2O_3$, TiN, ZrN and BN are coated on a diamond tip by a CVD or a PVD method to improve the adhesion to the diamond tip, and thereby increases the life of the tool. In Japanese Patent Laid-Open Publication No. Heisei 1-104970 and Korean Patent Laid-Open 92-801, a metal deposition process (vacuum evaporation, ion plating, MO CVD, or sputtering process) is performed with at least one metal selected from the group consisting of Ti, Zr, Hf, V, Nb, Ta, Cr, Mo, W, Si, and the equivalents thereof on the surface of a super alloy of WC at least 80% by weight, and then a thin diamond film is deposited on the metal surface.

However, none of the prior arts employs the electroless plating method, which is superior in adhesion and capable of plating regardless of the types of material, in order to form a surface layer or an inter layer.

SUMMARY OF THE INVENTION

The present inventors have recognized that there is a need for a method for depositing a diamond film, superior in adhesion, and found out that a diamond coating on an electrolessly plated nickel layer is excellent in solving the above problem encountered in prior arts.

The object of the present invention is to provide a method for the deposition of a diamond film, superior in adhesion regardless of the material of a substrate to be plated.

The present invention for the deposition of diamond film comprises the successive steps of immersing metallic or nonmetallic material in an electroless nickel plating bath containing a reducing agent to form a nickel layer; and depositing the diamond film on the electrolessly plated material.

DETAILED DESCRIPTION OF PREFERRED EMBODIMENTS

Electroless plating is one kind of metal plating method using a chemical catalytic reaction and is different from electroplating in the point of coating formation by means of non-current flow. An electroless plating method can make a film on almost all kinds of materials, plastics, papers, fibers, ceramics, metals and so on. Any structure with a complicated shape can be coated by the electroless plating method, as well. In addition, the electroless plated coating has excellent physical properties for various usages, such as corrosion resistance, alkali resistance, solderability, adhesion, and thermal resistance, and thus is applied to various objects, such as automobiles, aircrafts, machine, electronic parts, chemical plants and so on.

In accordance with the present invention, a material, metallic or nonmetallic, is initially plated with a nickel layer by an electroless plating process and then deposited with a diamond film.

Utilizing electroless plating, the method provided by the present invention can improve the adhesion of a diamond film to substrate materials. In addition, the method employed in the present invention can be generally carried out regardless of the materials to be plated.

Electroless Ni—P plating or Ni—B plating methods are selected as general electroless plating methods using sodium hydrophosphite or an amine borane compound, respectively, as a reducing agent.

Deposition of the diamond film on the nickel layer may be carried out by one of a number of CVD methods such as thermal process, thermal filament process, microwave process, ECR microwave process or thermal plasma process (direct current or alternating current).

All kinds of material may be used as the substrate for the plating in the present invention, especially metals such as iron-based super hard tool metal, hard metal including Fe, Co, Ni or Cr, or nonmetals such as ceramics and plastics.

The preferred embodiments of the present invention will now be further described with reference to specific examples.

EXAMPLE 1

A specimen of super hard tool metal (WC+10% Co) was pretreated to activate its surface and then cleaned to remove contaminants such as oil and dust. Thereafter, it was subjected to an ultrasonic treatment in alcohol containing diamond powder (30 to 40 $\mu$m) for 2 hours. The ultrasonically treated specimen was immersed in an electroless Ni—P plating bath containing $NaH_2PO_2$ as a reducing agent at 90° C. for 1 hour, and then it was dried in a nitrogen atmosphere.

This nickel-coated specimen was placed in a chamber of reactive gas ($CH_4$: 0.5%, $O_2$: 1%, and $H_2$: controlled), on which a diamond film was then deposited at a substrate temperature of 900° C. under reduced pressure of 40 torr for 6 hours, using a microwave CVD method with a microwave power of 2.54 GHz and 1,100 W, in order to obtain a thickness of about 5 $\mu$m.

Figure 1:
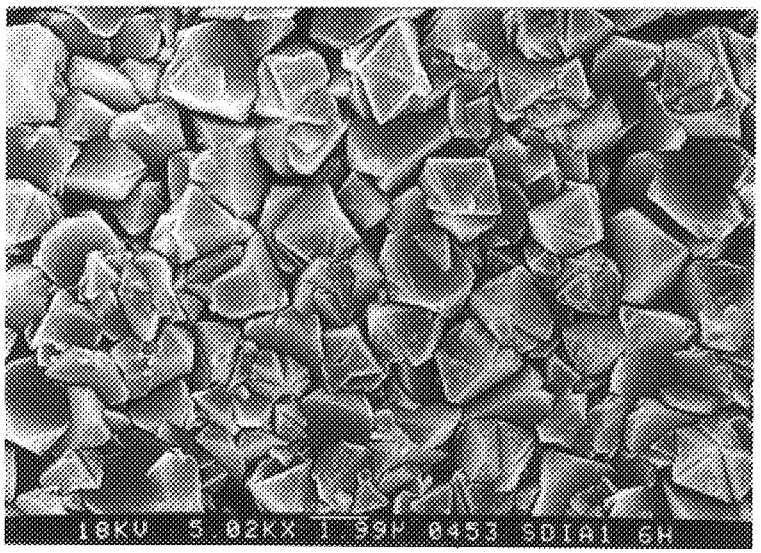
FIG. 1 is a scanning electron microscopic photograph magnified by five hundred times, showing a diamond film according to an Example 1 of the present invention.

The resulting deposited specimen was analyzed by Raman spectroscopy, to show the diamond peak at 1,333 $cm^{-1}$. Its surface was observed using a scanning electron microscope to confirm the diamond film as shown in FIG. 1.

The diamond coating thus obtained is about 10 times superior in adhesion as compared to that obtained without an electroless plated nickel layer.

EXAMPLE 2

Nickel was coated for 1 hour on a pretreated super hard tool (WC+15% Co) in the same manner as Example 1, except that an electroless Ni—B plating bath contained dimethylamineborane as a reducing agent and was maintained at 50° C. Thereafter, it was dried in nitrogen atmosphere.

A diamond film was then deposited on the nickel plated specimen using a microwave CVD method under the same condition as Example 1.

Figure 2:
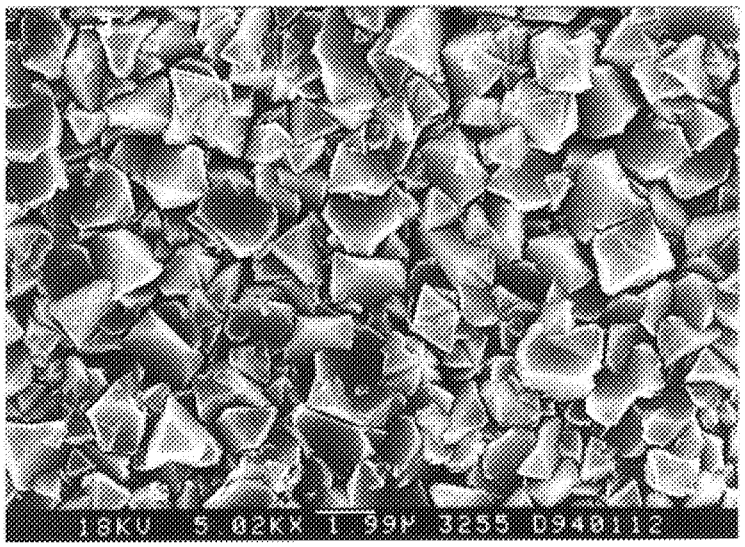
FIG. 2 is a scanning electron microscopic photograph magnified by five hundred times, showing a diamond film according to an Example 2 of the present invention.

In Raman spectroscopic analysis, the diamond peak at 1,333 $cm^{-1}$ was observed. Using scanning electron microscope, the surface of the diamond coating was observed as shown in FIG. 2.

EXAMPLE 3

A $Si_3N_4$ ceramic specimen was subjected to electroless Ni—P plating in the same manner as Example 1.

Thereafter, the nickel-plated ceramic specimen was placed in a chamber of reactive gas ($CH_4$: 1%, $H_2$: 99%) on which a diamond film was then deposited at 200 V under reduced pressure of 70 torr for 6 hour, using a thermal filament CVD method with a filament temperature and a substrate temperature of 2,000° C. and 850° C., respectively, and a bias Voltage of −20 V.

The deposited specimen was analyzed by Raman spectroscopy, to show the diamond peak at 1,333 $cm^{-1}$. The surface was observed using a scanning electron microscope to confirm the diamond film similar to that of Example 1.

EXAMPLE 4

A $Si_3N_4$ ceramic specimen was subjected to electroless Ni—B plating in the same manner as Example 2.

A diamond coating was then deposited on the nickel-plated ceramic specimen in the same manner as Example 3.

For the resulted deposited specimen, Raman spectroscopic analysis and scanning electron microscopic observation were carried out. Similar results to Example 3 were obtained.

EXAMPLE 5

After a specimen of super hard tool metal (WC+10% Co) was subjected to electroless Ni—B plating as in Example 2, it was applied with a power of 10 kw discharged from an anode, using Ar and $H_2$ as a plasma-generating gas. And then, raw gas of $CH_4$ was introduced from below the anode. The flow rates of Ar, $H_2$ and $CH_4$ gases were 15–30 1/min., 1–20 1/min., and 0.5–5 1/min., respectively.

Using a direct current thermal CVD process, the diamond film was deposited on the specimen at a substrate temperature of 1,000° C. under the pressure of 50 torr for 10 minute.

The results of Raman spectroscopic analysis and scanning electron microscopic observation were similar to those of Example 1.

The diamond film deposited on the nickel layer is at least 10 times superior in adhesion as compared to that deposited on the bare surface.

EXAMPLE 6

A silicon wafer (P-type) was subjected to electroless nickel plating and coated with a diamond film in a similar manner to that of Example 1.

The deposited specimen analyzed by Raman spectroscopy shows the same results as in Example 1. The surface of the resulted film observed by scanning electron microscope is the same as in Example 2.

EXAMPLE 7

A brass-based specimen was subjected to electroless nickel plating and coated with a diamond film in a similar manner to that of Example 1, except that the substrate temperature was 500° C.

The results of Raman spectroscopic analysis and scanning electron microscopic observation were similar to those of Example 1.

Other features, advantages and embodiments of the invention disclosed herein will be more apparent to those exercising ordinary skills after reading the foregoing disclosures. In this regard, while specific embodiments of the invention have been described in considerable detail, variations and modifications of these embodiments can be effected without departing from the spirit and scope of the invention as described and claimed.

What is claimed is:

1. The method for the deposition of a diamond film, comprising the steps of:

immersing a metallic or nonmetallic substrate in an electroless nickel plating bath containing a reducing agent to form a nickel layer on said substrate; and depositing said diamond film on said electroless nickel-plated substrate.

2. The method for the deposition of a diamond film as set forth in claim 1, wherein the reducing agent for the electroless nickel plating bath is $NaH_2PO_2$ or dimethylamineborane.

3. The method for the deposition of a diamond film as set forth in claim 1, wherein the step of depositing said diamond film comprises a thermal chemical vapor deposition process, a microwave chemical vapor deposition process, an electron cyclotron resonance microwave chemical vapor deposition process, or AC or DC plasma chemical vapor deposition process.

* * * * *